US005300906A

United States Patent [19]

Blanchard et al.

[11] Patent Number: 5,300,906

[45] Date of Patent: Apr. 5, 1994

[54] CURRENT SWITCHING DEVICE

[75] Inventors: Christian Blanchard, Rueil Malmaison; Michel Lauraire, Courbevoie; Didier Vigouroux, Jouy-le-Moutier, all of France

[73] Assignee: Telemecanique, Rueil Malmaison, France

[21] Appl. No.: 1,633

[22] Filed: Jan. 7, 1993

[30] Foreign Application Priority Data

Jan. 7, 1992 [FR] France ..... 92 00147

[51] Int. Cl.[5] ..... H01H 9/20

[52] U.S. Cl. ..... 335/167; 335/132

[58] Field of Search ..... 235/167-176, 235/23-25, 22, 131-132

[56] References Cited

U.S. PATENT DOCUMENTS 3,453,566 7/1969 Kasahara .

FOREIGN PATENT DOCUMENTS 1192265 5/1956 Fed. Rep. of Germany .
964159 1/1966 Fed. Rep. of Germany .
943479 7/1967 Fed. Rep. of Germany .
1464396 9/1974 France .
1355035 5/1957 United Kingdom .
1367351 3/1962 United Kingdom .

*Primary Examiner*—Lincoln Donovan

*Attorney, Agent, or Firm*—Oblon, Spivak, McClelland, Maier & Neustadt

[57] ABSTRACT

A current switching device includes stationary contacts, and movable contacts which are movable between a position in which the movable contacts engage the stationary contacts and a position in which the movable contacts separate from the stationary contacts. The movable contacts are mounted on a movable contact holder. A magnetic locking element includes a permanent magnet and is pivotally mounted about a fixed axis. An actuation armature is connected to the contact holder and is movable to move the contact holder. The actuation armature is movable in proximity to the magnetic locking elements such that the actuation armature is locked to the magnetic locking element by magnetic attraction with the movable contacts engaging the stationary contacts. An opening armature is movable between a rest position and a position in proximity to the magnetic locking element, such that the opening armature is locked to the magnetic locking element by magnetic attraction. When the opening armature is in proximity to the magnetic locking element, the magnetic attraction between the actuation armature and the magnetic locking element is reduced such that the actuation armature is freed to permit the movable contacts to separate from the stationary contacts. A tripping device is sensitive to a current overload and causes the opening armature to move to the position in proximity to the magnetic locking element.

9 Claims, 4 Drawing Sheets

CURRENT SWITCHING DEVICE

BACKGROUND OF THE INVENTION

1. Field of the Invention

This invention relates to a current switching device controlled manually by a manual control element and comprising, in a box, a magnetic locking element with a permanent magnet that cooperates both with an actuation armature acting on a bridge of moving contacts cooperating with stationary contacts of a pole and with an opening armature that can be displaced by protective means that are sensitive to overloads or excess currents.

2. Description of the Related Art

Lock mechanisms are used in single- or multi-phased circuit breakers. A known mechanism comprises a manual control element (button) able to compress the springs that apply the moving contacts against the stationary contacts. Furthermore, this mechanism can receive opening orders from trip mechanisms that act to cause the rapid opening of the contacts. They almost always combine protection from overloads and from short circuits.

French patent 1,464,396 and British patent 1,355,035 describe magnetic-type mechanisms comprising a permanent magnet that works with an armature displaced by a trip mechanism, and an armature that is integral with the moving contact. The approach of the armature associated with the trip mechanism frees the armature that is integral with the moving contact. If it is desired to produce a device with several poles, just as many magnet mechanisms are necessary.

SUMMARY OF THE INVENTION

The invention has as an object to provide a lock mechanism suitable for a multipolar device. It assures a quick closing and opening of the contacts.

In the mechanism according to the invention, the actuation armature acts on a moving contact holder in which at least one slide associated with a contact bridge slides.

According to a further characteristic, the mechanism comprises locking means that can immobilize the contact holder of the moving contacts in off position and the magnetic locking element in on position.

According to a still further characteristic, the manual control element is connected to a control lever mounted to pivot on the box and that can displace in rotation the magnetic locking element that is mounted to pivot.

According to yet a further characteristic, the end of the actuation armature is connected by a hinged connection to the support of the moving contact holder.

According to another characteristic, the mechanism comprises means for hooking the opening armature that are able to be actuated by the protective means so as to free said armature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
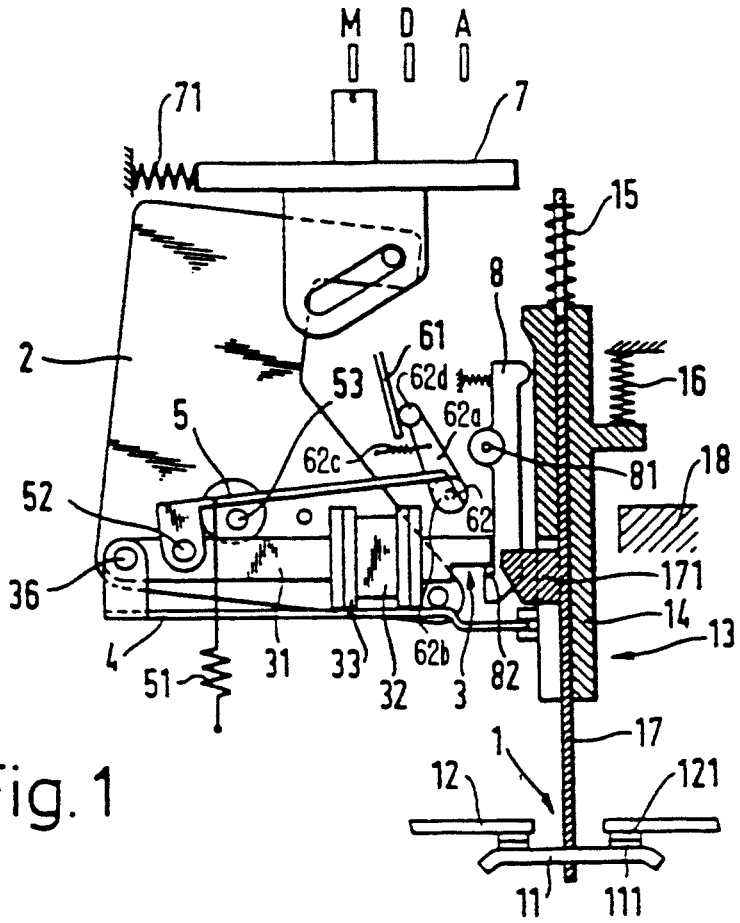
FIG. 1 is a diagram of an embodiment of the lock mechanism according to the invention, in on position.

The drawings show a circuit breaker-type current switching device. This device comprises one or more poles 1 housed in a box. Each pole 1 comprises stationary and moving parts supporting the separable contacts. In the drawings, a single pole 1, of the double break type, is shown. It comprises conductors 12 connecting the connecting terminals to stationary contacts 121 and a moving bridge 11 carrying moving contacts 111. Moving bridge 11 is mounted in a contact holder 13 that slides in the box, perpendicular to the plane that passes through the stationary contacts. Contact holder 13 comprises a sliding support 14 and a slide 17 guided in a housing of this sliding support.

Slide 17 is integral with contact bridge 11. It is subject to the force of spring 15 that tends to displace slide 17 and bridge 11 upward in relation to moving support 14, i.e., in the direction of closing of the contacts. Spring 15 works in compression and rests on the upper part of moving support 14, and it pushes on the end of slide 17. Moving support 14 can guide several slides 17 carrying contact bridges 11.

Figure 2:
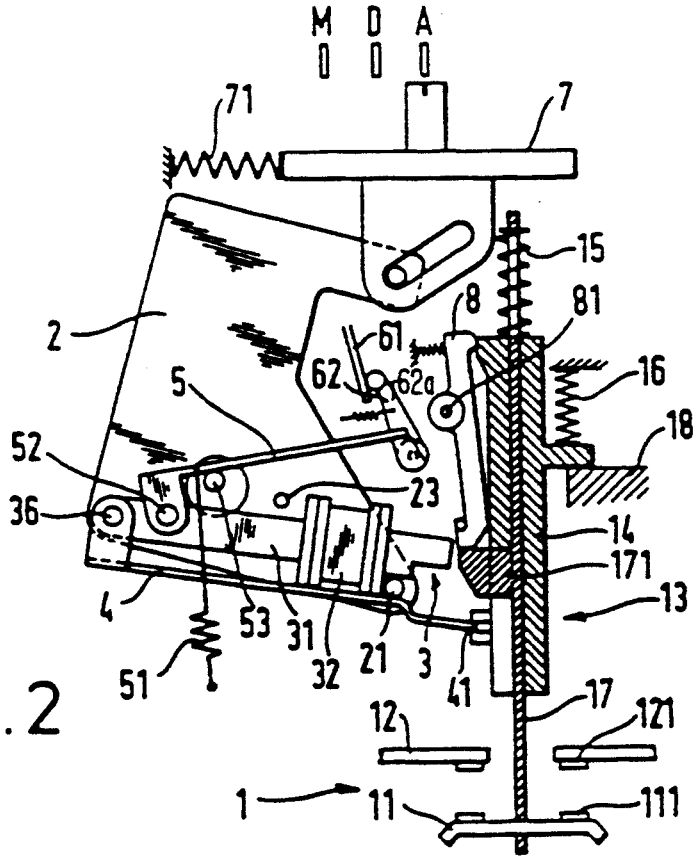
FIG. 2 is a diagram of the mechanism of FIG. 1, in off position.

Moving support 14 is subject to the force of an opening spring 16 that tends to displace it toward the off position (open contacts). The translation movement of moving support 14 due to spring 16 is limited by a stop 18 corresponding to the off position (FIG. 2).

The mechanism includes a magnetic locking element 3 that consists of a lever 31 carrying a permanent magnet 32 and a yoke 33 of soft magnetic material. Locking lever 31 is mounted to pivot around a pivot pin 36 fixed on the box (not shown).

A control lever 2 is also mounted to pivot around the pivot pin 36. It makes it possible to actuate magnetic locking element 3 and the associated parts. This lever 2 is connected mechanically to a manual control element 7 of the sliding button type. This control button 7, when it is displaced manually, causes control lever 2 to pivot between the closing-of-the-contacts or on position shown in FIG. 1 and the opening-of-the-contacts or off position shown in FIG. 2. Control button 7 is guided in translation by means which are not shown and is subject to a return spring 71.

Figure 3:
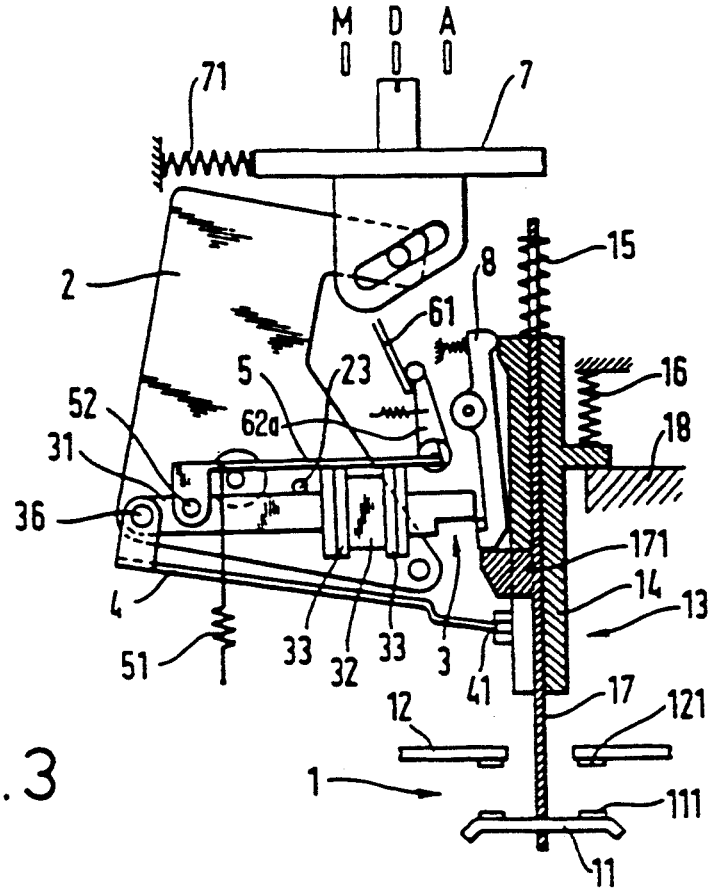
FIG. 3 is a diagram of the mechanism of FIG. 1 in "tripped" position.
Figure 4:
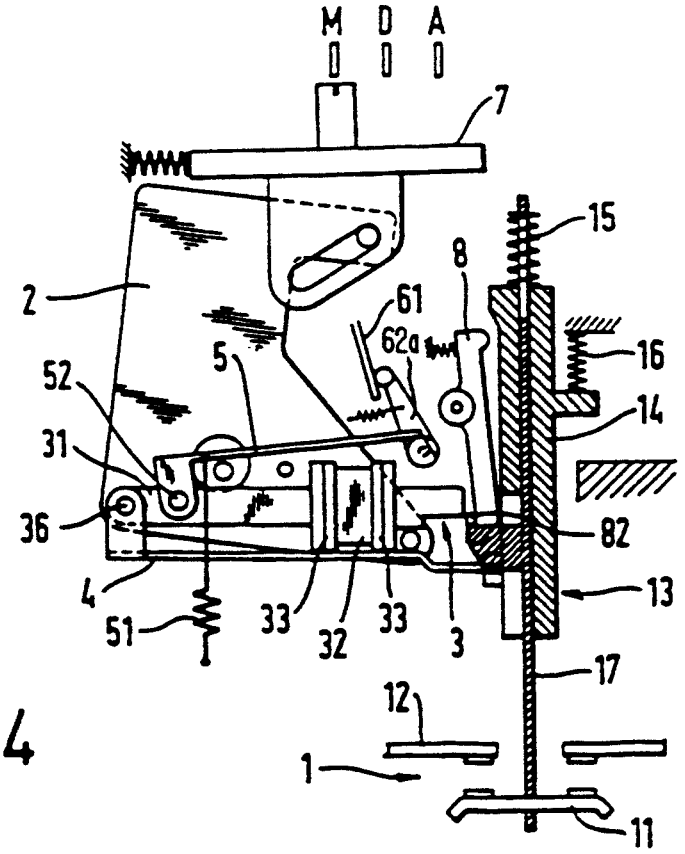
FIG. 4 is a diagram of the mechanism of FIG. 1, in quick closing position.

An armature 5 for tripping opening is formed of soft magnetic material and is mounted to pivot around a pivot pin 52 on lever 31. It is subject to the force of a spring 51 and pivots between a rest position (FIG. 1) where it is far from the magnet 32 and a work position (FIG. 3) where it is close to the magnet. The displacements of this armature 5 for tripping opening are controlled by a trip 61 in order to assure protection from overloads and short circuits. The armature 5 is normally held at its rest position by the projection 62 of a pivot arm 62*a* mounted to a fixed axis 62*b* and held by spring 62*c* in the illustrated position in which the end 62*d* of the pivot arm is pressed on the trip 61. On the appearance of a failure current, armature 5 for tripping open is freed from its rest position by trip 61 rotating the pivot arm 62a until the armature 5 is released by the projection 62. Spring 51 then acts on armature 5 for tripping open to draw it near magnet 32.

An actuation armature 4, made of soft magnetic material, is also mounted to pivot around the pivot pin 36. It is able to pivot between a work position where it is subject to the attraction of magnet 32 and is near locking element 3 and a rest position (FIG. 3) where it is far from this locking element 3.

A moving lock 8 mounted to pivot around a fixed pin 81 is able to immobilize contact holder 13 in opening-of-the-contacts position (FIG. 2) and to immobilize magnetic locking element 3 in on position.

In the embodiment of FIGS. 1 to 4, the end of armature 4 is connected by a hinged connection 41 to support 14. The translation movement of slide 1 in relation to support 14 (under the action of spring 15), in the direction of closing of the contacts, is limited by a stop 171 of the slide that rests against support 14. The immobilization of the contact holder 13 by the moving lock 8 is achieved by the moving lock engaging the stop 171 (FIG. 2).

In the variant of FIGS. 5 to 8, actuation armature 4 in not connected by its end to support 14. It includes an intermediate lever 9 that also pivots around pivot pin 36, and that is connected by its end to moving support 14. A spring 91 tends to bring intermediate lever 9 and actuation armature 4 near.

The operation of the mechanism will now be explained.

Figure 5:
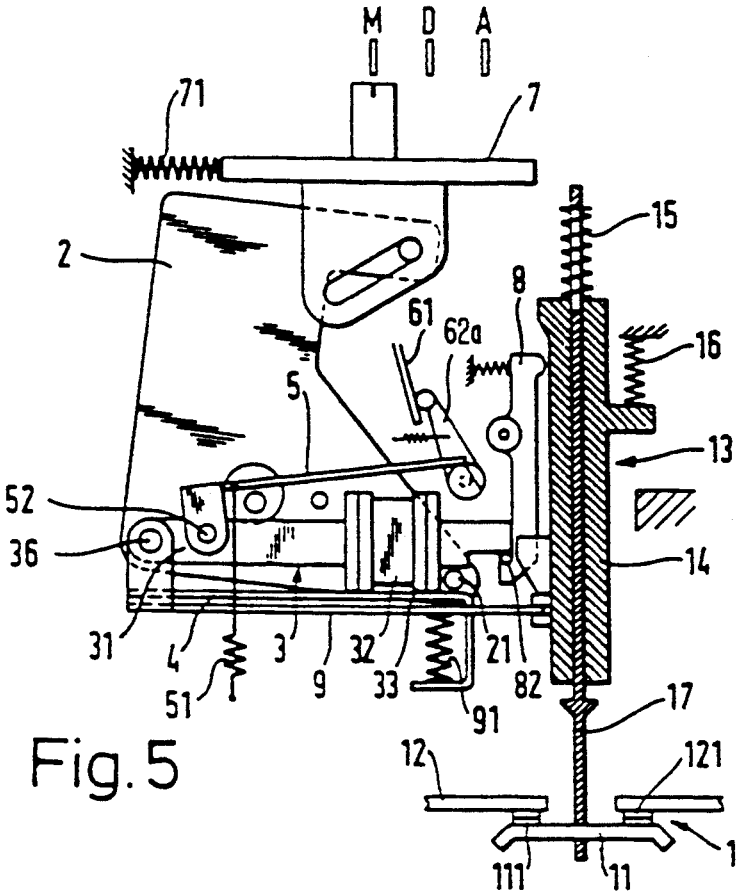
FIGS. 5 to 8 diagrammatically illustrate a variant of the mechanism illustrated by FIGS. 1 to 4, FIG. 5 corresponding to the on position, FIG. 6 to the off position, FIG. 7 to the tripping position, FIG. 8 to the quick closing.

In the on or closing-of-the-contacts position shown in FIG. 1 or 5, the flux created by magnet 32 forms a flux path which includes actuation armature 4, which is therefore held against locking element 3 by the magnetic attraction force of magnet 32. The force exerted on this armature 4 is greater than the force of opening spring 16 and so the spring 16 is compressed. Magnetic locking element 3 is immobilized in rotation around pin 36 by lock 8 which hooks the end of lever 31 at pin 82. Slide 17 is pushed up by spring 15 and the moving contacts are applied against the stationary contacts. The holding in this on and closing position is therefore obtained by mechanical and magnetic means, without consumption of energy.

Figure 6:
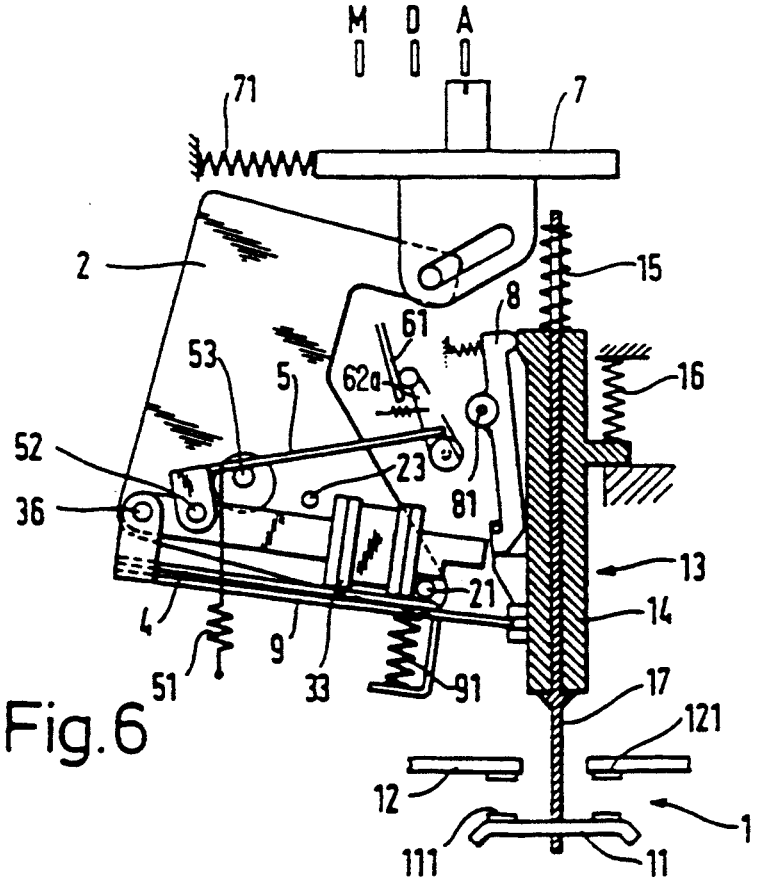
Figure 7:
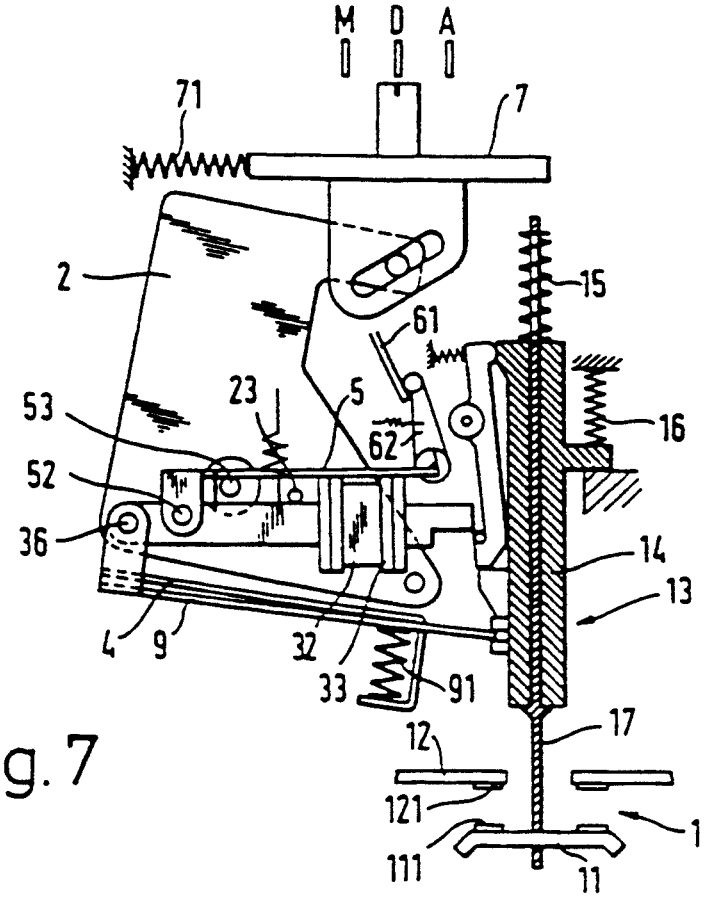
Figure 8:
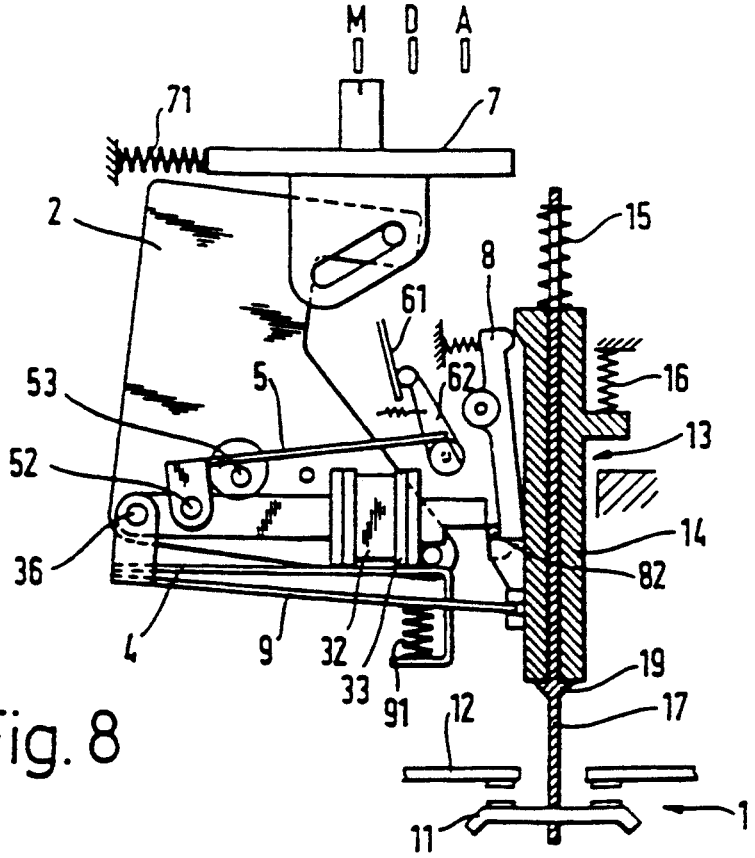

When control button 7 is actuated in the off direction, i.e., from position "M" to position "A", the clockwise pivoting of control lever 2 causes pin 21 of control lever 2 to separate armature 4 from magnetic locking element 3, and armature 4 pivots in a clockwise direction due to spring 16. Actuation armature 4 carries moving support 14 and slide 17 along. Moving support 14 then causes lock 8 to turn, by a boss at its upper end, which frees magnetic locking element 3. The latter pivots under the action of spring 51 and presses against armature 4 (FIG. 2 or 6). During this time, the armature 5 is kept separated from the magnet 32 by the projection 62.

In case of failure (overload or short circuit), trip 61 causes pivot arm 62a to rotate, which frees armature 5 from projection 62 for tripping opening of the contacts. Armature 5 then presses against magnet 32. The flux created by magnet 32 is then distributed in both armatures 4 and 5, and so the magnetic force exerted on actuation armature 4 becomes weaker than the force of spring 16. Actuation armature 4 is thus freed and can separate from magnetic locking element 3. Contact holder 13 is then displaced under the action of opening spring 16 to occupy the "tripped" position illustrated by FIG. 3 or 7.

To go from the "tripped" position (FIG. 3 or 7) to the "off" position (FIG. 2 or 6), control button 7 is displaced from the "D" position to the "A" position, which causes control lever 2 to pivot clockwise. As lever 2 pivots, pin 23 of this lever pushes locking element 3 to the "off" position (FIG. 2 or 6). This pivoting makes it possible for actuation armature 4 to again engage magnet 32. Moreover, during pivoting of the control lever 2, stationary pin 53 engages armature 5 for separating armature 5 from the magnet 32 and again engaging armature 5 on projection 62, thereby returning the device into resetting position. This resetting of armature 5 is necessary so that magnetic locking element 3 can be brought back into the on or closing-of-the-contacts position (FIG. 1 or 5).

To go from the off position (FIG. 2 or 6) to the on position, manual control button 7 is displaced to position "M", which causes lever 2 to pivot counterclockwise. This movement of rotation of lever 2 simultaneously brings actuation armature 4 and magnetic locking element 3 back toward the on position of FIG. 1 or 5 due to engagement of pin 21 with locking element 3 and the force of magnet 32. Initially, lock 8 prevents slide 17 from rising with support 14. However, at the end of its travel, magnetic locking element 3 permits the rotation of lock 8 which frees slide 17, until then held by lock 8. This makes possible a quick closing (FIG. 4 or 8) of contact holder 13.

In case of soldering of the contacts, force can be exerted on armature 4 by acting on control button 7 to free the contacts.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A current switching device comprising:

stationary contacts;

movable contacts movable between a position in which the movable contacts engage the stationary contacts and a positioning in which the movable contacts separate from the stationary contacts;

a movable contact holder on which said movable contacts are mounted;

a magnetic locking element including a magnet;

an actuation armature connected to said contact holder and movable to move said contact holder, said actuation armature being movable in proximity to said magnetic locking element such that said actuation armature is locked to said magnetic locking element by magnetic attraction, with said movable contacts engaging the stationary contacts;

means for biasing said actuation armature away from said magnetic locking element;

an opening armature movable between a rest position and a position in proximity to said magnetic locking element such that said opening armature is locked to said magnetic locking element by magnetic attraction, wherein the opening armature in proximity to said magnetic locking element reduces the magnetic attraction between said actuation armature and said magnetic locking element such that said actuating armature is freed to be moved by said biasing means so as to permit the movable contacts to separate from the stationary contacts; and protective means sensitive to a current overload for causing said opening armature to move to the position in proximity to said magnetic locking element.

2. The device of claim 1 including locking means for locking said contact holder in a position in which said movable contacts are separate from said stationary contacts.

3. The device of claim 1 wherein said contact holder comprises:

a plurality of slides in which said movable contacts are mounted;

a support in which said slides are movably mounted, said actuation armature being connected to said support; and a spring biasing said support toward the position in which said movable contacts are separate from said stationary contacts.

4. The device of claim 1 wherein said magnetic locking element is mounted for pivotal movement about a fixed axis, further including:

a control lever pivotally mounted on said fixed axis and having means for engaging nd moving said magnetic locking element; and a manual control element engagable with said control lever to pivot said control lever.

5. The device of claim 1 wherein said actuation armature is pivotally connected to said contact holder.

6. The device of claim 1 wherein said magnet comprises a permanent magnet.

7. The device of claim 1 wherein said protective means comprise:

a projection biased to a position to retain said opening armature at the rest position; and a trip mechanism sensitive to a current overload for moving said projection.

8. The device of claim 1 wherein said opening armature is pivotally mounted to said magnetic locking element.

9. The device of claim 1 wherein said actuation armature includes an intermediate lever, wherein said intermediate lever is connected to said contact holder.

* * * * *